United States Patent [19]

Saint Julian et al.

[11] Patent Number: 4,626,204

[45] Date of Patent: Dec. 2, 1986

[54] HIGH-TEMPERATURE HOT-AIR GENERATOR

[75] Inventors: Raymond M. Saint Julian, Couvrut; Philippe M. Gehant, Le Chesnay; Ivan G. Bertrand, Paris; Michel H. Folliet, Gargenville, all of France

[73] Assignee: Societe des Ciments Francais, France

[21] Appl. No.: 753,392

[22] Filed: Jul. 10, 1985

[30] Foreign Application Priority Data

Jul. 10, 1984 [FR] France ..... 84 10953

[51] Int. Cl.[4] ..... F24H 1/00

[52] U.S. Cl. ..... 432/222; 431/183; 431/186; 431/188; 431/190; 110/265

[58] Field of Search ..... 431/351, 352, 165, 177, 431/178, 174, 183, 186, 189, 10, 188, 190; 110/262, 261, 244, 265; 432/222

[56] References Cited

U.S. PATENT DOCUMENTS 4,113,417 9/1978 Deruelle ..... 431/10

4,333,405 6/1982 Michelfelder et al. ..... 431/183

4,396,368 8/1983 Faccini et al. ..... 431/10

*Primary Examiner*—Carroll B. Dority, Jr.

*Attorney, Agent, or Firm*—Darby & Darby

[57] ABSTRACT

The hot air generator according to the present invention comprises a vertical cylindrical enclosure whose walls are covered on the inside with refractory brick, the heating burner being placed at the top of the enclosure and the hot air exhaust orifice being situated at the base thereof, and in which the source of air by which it is fed is divided into three distinct flows: a first flow constituting the combustion air from the burner; a second flow constituting a first current of dilution air cylindrically surrounding the flame; a third flow constituting a second current of dilution air insufflated at the base of the enclosure so that the enclosure comprises three temperature zones: a first temperature zone which is that of the flame and is on the order of 1,800°; a second temperature zone downstream of the flame and on the order of 900°; a third temperature zone which is that of the second dilution current mixes with the flux of hot air which is comprised between 850° and 300°.

10 Claims, 6 Drawing Figures

HIGH-TEMPERATURE HOT-AIR GENERATOR

Figure 1:
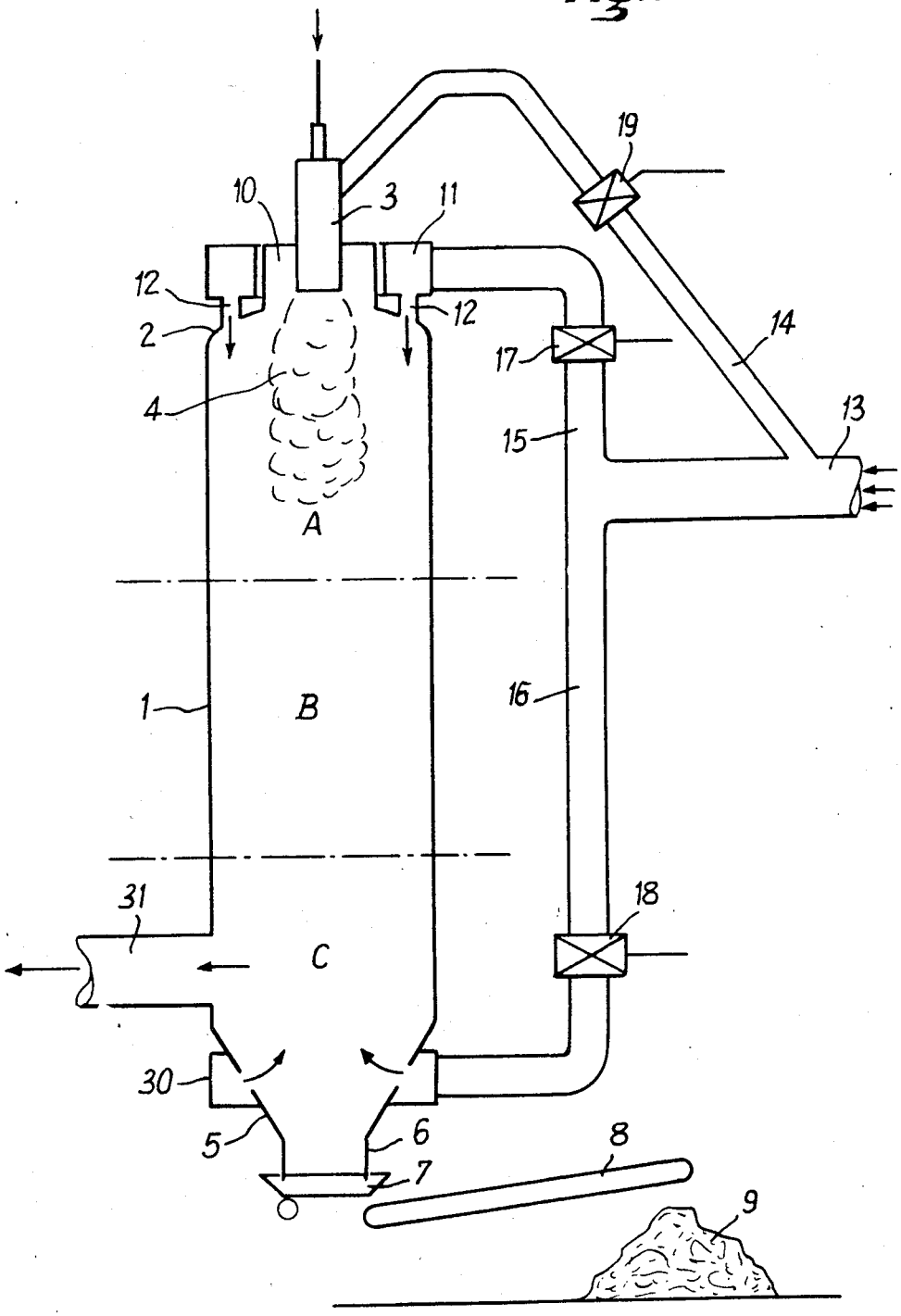

The subject of the present invention is a hot-air generator having a temperature comprised between 400° and 850° intended, for example, for drying green cement or brick products. This hot-air generator can, for example, be fed with powdered fuel.

We are familiar with the heating or reheating of a flux of air by causing it to pass through an enclosure, inside which a flame is burning so as to obtain a flux of drying air that can be used to dry green products such as, for example, in a grinder. When this air is wanted to dry wet products coming from a quarry and arriving in a grinder, it is necessary to make such a grinding possible, that the temperature of the air not be too high in order not to damage the mechanical components of the grinder. In practice, the best protected grinders can withstand temperatures ranging up to 850° in some cases, which makes for a maximum limit, while others remain below 400°. If the drying is sufficient, it is possible to go below 400°.

When liquid or gaseous hydrocarbons are used as fuel, the temperature regulation poses no problem. But when powdered, solid combustibles such as coal are used the problem of temperature regulation becomes difficult to solve. These products are sometimes difficult to ignite while offering high risks of explosion resulting from a flame-failure with accumulation of unignited products that can ignite suddenly.

The ignition of solid particles of coal is generally done by igniting gases produced by their own volatile materials given off by pyrolysis when heated, the process being then self-sustaining by the heat given off by the combustion of the said volatile products. But coals can be lean to the point that they contain only a negligible amount of volatile materials. This is the case of petroleum coke and anthracite or graphitous coals. It can often happen, and this is the case of many lean schists, that the volatile materials are constituted for the most part by $CO_2$ and $H_2O$ which are nonflammable gases. Furthermore, if such lean schists are used, their combustion produces ash with a clay base which must not be raised to temperatures such that the clay will melt because then there is the risk of clogging the heating furnace.

As a result, these lean coals, although abundant and cheap, are not used.

The present invention has an object an installation making it possible to obtain a flux of drying air at temperatures ranging as desired up to the grinder (850 or 400 depending on the type), while using, as fuel, powdered lean coal such as clay schist coals with up to 50 percent and more ash.

The generator according to the present invention comprises a vertical cylindrical enclosure whose walls are covered on the inside with refractory brick, the heating burner being placed at the top of the enclosure and the hot air exhaust orifice being situated at the base thereof, and in which the source of air by which it is fed is divided into three distinct flows: a first flow constituting the combustion air from the burner; a second flow constituting a first current of dilution air cylindrically surrounding the flame; a third flow constituting a second current of dilution air insufflated at the base of the enclosure so that the said enclosure comprises three temperature zones: a first temperature zone which is that of the flame and is on the order of 1,800°; a second temperature zone downstream of the flame and on the order of 900°; a third temperature zone which is that of the second dilution current mixes with the flux of hot air which is comprised between 850° and 300°.

By way of nonlimiting example, and to facilitate comprehension of the invention, the attached drawings show:

In FIG. 1 a schematic view in lateral elevation of a generator according to the present invention.

Figure 2:
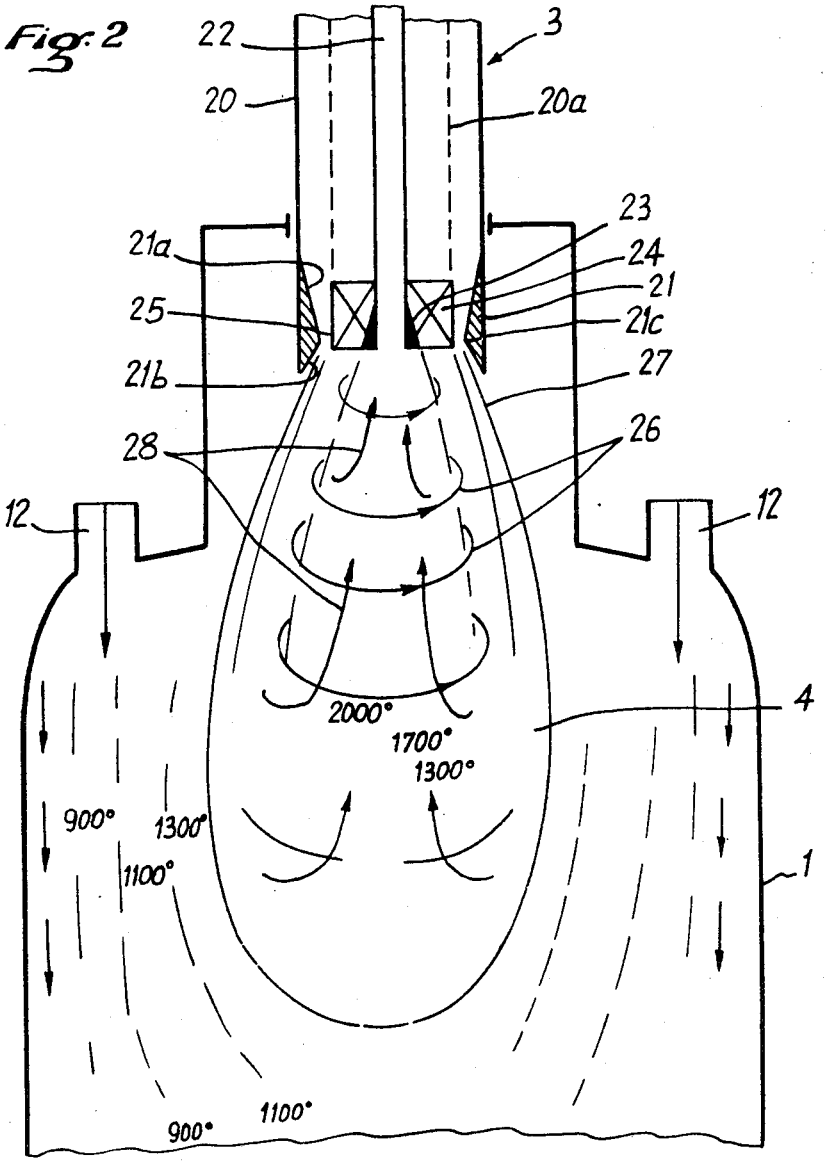

In FIG. 2, a detail on a larger scale illustrating the top of the generator according to FIG. 1.

Figure 3:
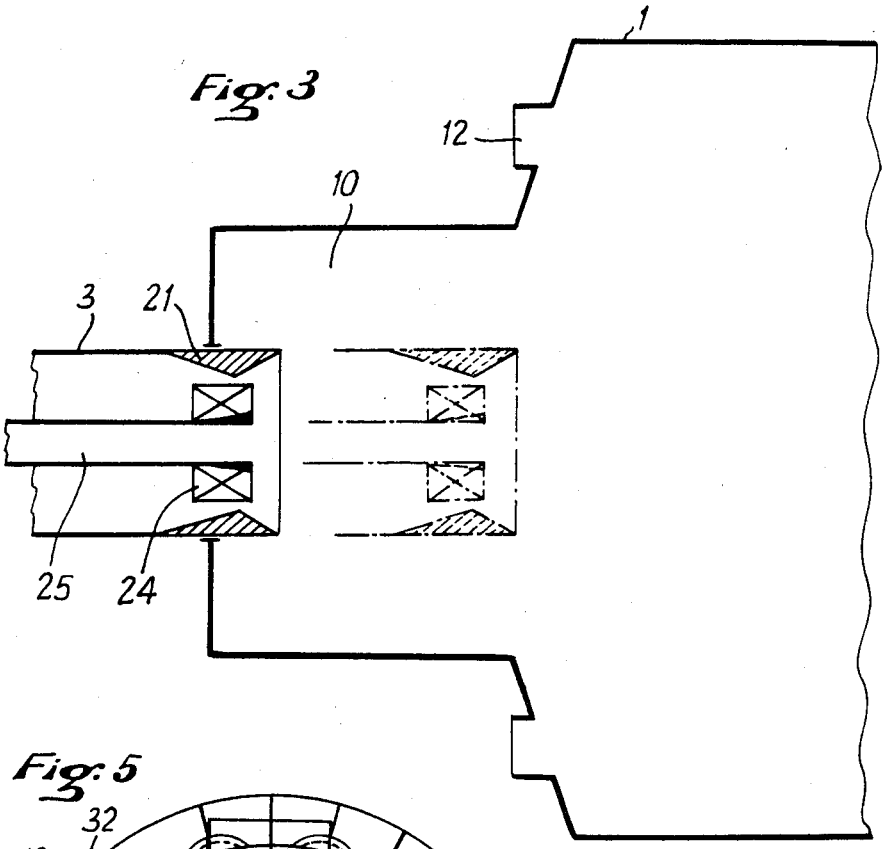

In FIG. 3, a detail of FIG. 2 illustrating the movement of the tuyere assembly in the generator input chamber.

Figure 4:
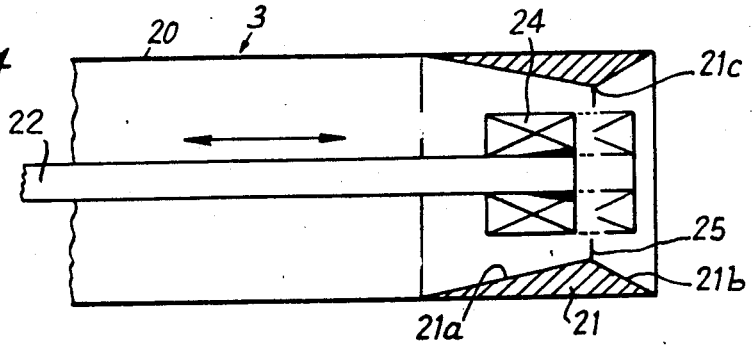

In FIG. 4, a detail of FIG. 1, illustrating the movement of the vane-support rod in the tuyere.

Figure 5:
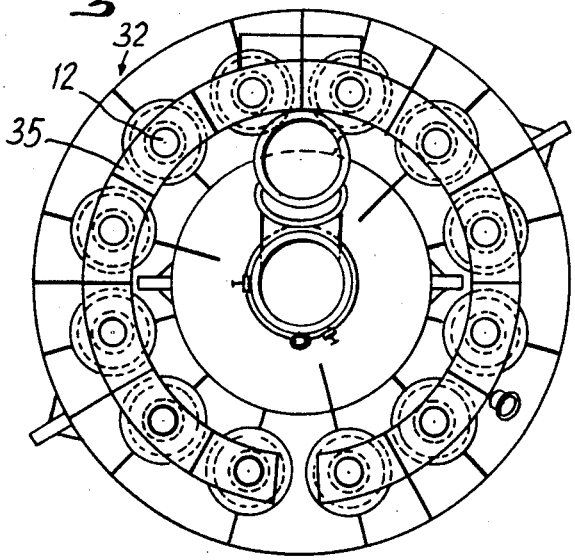

In FIG. 5, an overhead view of the generator.

Figure 6:
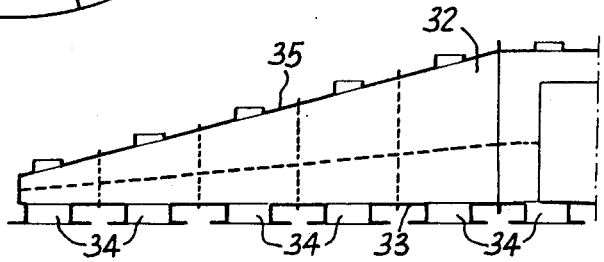

In FIG. 6, an exploded view of the distributor of pressure of the first dilution current.

Referring to FIG. 1, we see that the generator consists of a cylindrical jacket 1, with vertical axis, whose upper wall 2 contains a burner 3 producing a flame 4 and whose lower end 5 is conical and opens into a vertical stack 6 in a rotary water tank 7, associated with a conveyor 8 to remove the ashes 9.

In the center of the upper part 2 there is a cylindrical chamber 10 whose walls are lined with refractory brick, in which the burner 3 opens. This chamber 10 is surrounded by a circular chest 11 which opens into the inside of enclosure 1 through a plurality of openings 12.

Duct 13 brings the air which is to be heated into enclosure 1. The air can be cold air or can be recovery air coming, for example, from a baking furnace or from a clinker cooler or the like.

A first part of this air is picked up by a duct 14 and sent into the tuyere of burner 3 to serve as air of combustion. Downstream of duct 14, duct 13 divides into two ducts 15 and 16, duct 15 opening into chest 11 and duct 16 opening into the lower end 5 of jacket 1. Duct 15 comprises an electrovalve 17 and duct 16 has an electrovalve 18. These two electrovalves making it possible to regulate the flow of air into ducts 15 and 16.

FIGS. 2–4 show in more detailed fashion the burner 3 and its chamber 10 into which it opens.

Burner 3 is constituted by a tuyere 20 terminating at its end in a convergent-divergent 21, the slope of the convergent being gentler than that of the divergent. Inside tuyere 20 there is mounted coaxially a hollow rod 22. At its end this hollow rod 22 is equipped on its outer wall with a divergent 23 on the one hand, having a gentle slope, opposite that of convergent 21, and on the other hand, a system of vanes schematized at 24. The slope of divergent **21*b* is on the order of 30° while that of divergent 23 is on the order of 7° to 8°. By mechanical means of known type, and therefore not represented or described, it is possible either to displace tuyere 20 and rod 22 together, or to displace rod 22 alone relative to the tuyere. Vanes 24 are narrower than the distance separating the culminating points of divergent 23 and convergent 21 so as to form an annular open space 25**.

Through rod 22 there arrives an igniting or supplementary fuel which is either a gaseous or fluid combustible such as fuel oil, certain alcohols or other products of recuperation. In the space surrounding rod 22, inside tuyere 20 there arrives a mixture of powdered fuel (for example, ground, lean schistous coal) and a flow of combustion air coming from duct 14.

The flow of this air plus powdered solid fuel is squeezed between convergent 21*a* and divergent 23, then expanded between the two divergents 21*b* and 23.

The part of this flow that passes through the vanes 24 is given an eddying movement as schematized at 26; while the part passing through space 25 and not agitated by the vanes, fans out as represented at 27.

The fluid streams which are in the vicinity of zone 26 are deflected less than those licking divergent 21*b*. As a result there is a continuous variation of the speed of the fluid streams coming from annular zone 25, the speed decreasing from the inside out, or in other words the speed of the fluid streams is inversely proportional to the extent of their fanning. Experience teaches that the fastest (inside) airstreams exert an aspiration effect on the slower (outside) airstreams which results in centripetal eddies which are represented at 28 in FIG. 2. Moreover, the difference in slope between divergent 21*b* and divergent 23 produces the formation of a central conical zone that affects the eddy zone. Ignition is obtained by injecting (as is known) a liquid or gaseous combustible product, such as a hydrocarbon, through rod 22, and igniting it. The conjugated effects of a central cone, eddies 26 and eddies 28 make for a complete agitation of the entire mass of air loaded with fuel and hence a complete ignition of all of the particles of solid fuel, even with very lean schistous coal loaded heavily with impurities.

Means are provided to modulate as desired, on the one hand the respective magnitude of zones 26 and 27 and on the other hand the position of the flame in chamber 10, or "tap-hole" so that the flame may fan out to heat all of the interior of enclosure 1 without licking the edges of chamber 10. With this in mind, rod 22 can be displaced relative to the tuyere 20 and it is likewise possible to displace tuyere 20 and rod 22 together. When rod 22 is displaced so as to cause vanes 24 to penetrate upstream of the neck 21*c* /sic/convergent-divergent 21, the amount of flux of air plus combustible which is not rotated by vanes 24 is increased. Consequently, the magnitude of the flux corresponding to zone 27, is increased relative to that of the central eddy flux 28. From the position represented in FIG. 2, where the leading edge of the vanes 24 comes level with the neck 21*c*, the ratio between these two fluxes is practically constant. Moreover, the position of the end of convergent 23 relative to the neck 21*c* acts on the form of the flame. When this end is upstream of neck 21*c*, the fanning of the streams of air plus combustible is inhibited, while this fanning becomes greater and greater when divergent 23 passes beyond neck 21*c* and moves further out.

It is thus possible to regulate the relative proportions of the zones 26 and 27 and hence the conditions necessary for a proper ignition of the solid particles and regulate the form of the flame.

However, it could happen that, in order to obtain good ignition of the solid particles, we might be led to have a flame fanned out too widely that would lick the walls of chamber 10. To avoid this, the tuyere 20 plus rod 22 assembly is displaced and made to project to a greater or lesser extent as represented in FIG. 3.

The adjustment of the flame also involves the regulation of the proportion of air relative to the proportion of fuel, which is done by means of electrovalve 19 situated in duct 14.

Thanks to all these means of regulation, it is possible to obtain a stable flame whose temperature is adjustable from 1,300° to 2,000°, and at the same time to control the shape of this flame.

The air circulating in duct 15 and hence with a flow regulated by electrovalve 17, arrives in enclosure 1 through a plurality of orifices 12 distributed in circular fashion around chamber 10. As a result, flame 4 is to a certain extent enclosed within a tube of air coming from orifices 12. This arrangement is made to prevent the flame from licking the inner walls, lined with brick, of enclosure 1. As a matter of fact the device according to the present invention is intended essentially to permit the use of very lean coal, such as for example, schistous coals. Such coals have a very high percentage of impurities which can be as high as 50 percent and even more. In the case of schistous coals, the clay contained in the coal may melt in the flame if the temperature is too high and then adhere to the walls which will very quickly become fouled, so that the generator becomes unusable in a rather short time.

Normally the means of adjustment described above make it possible to regulate the temperature of the flame so that it will be high enough to burn all the combustible particles but, if possible, not too high so that the impurities or ash will be melted.

It is however, necessary sometimes to use temperatures such that certain impurities are melted.

The tube of air generated by orifices 12 prevents these molten materials from reaching the walls, and cools them so they will solidify again, but the cooling must not be too great so that the temperature prevailing in the vicinity of the flame will be lowered too far. This flux of air is also intended to prevent the flame 4 from coming in contact with the internal bricking of the enclosure 1 and hence to insure longer life for these bricks.

At the base 5 of enclosure 1 there is a circular chest 30 that receives air from air duct 16, whose flow is modulated by electrovalve 18.

Thus, from a single source of air there are three flows: a flow of combustion air carried by duct 14 toward the burner; a first flow of dilution air arriving through orifices 12 placed at the top of enclosure 1; and a second flow of dilution air, arriving in the opposite direction to the first. These three air flows define, in the enclosure, three temperature zones: a first zone A which is that in which the flame 4 is found; in this zone the temperature is on the order of 1,300° to 2,000°; a second zone B or intermediate zone in which the temperature is on the order of 800° to 900°; and a third zone C in which a temperature of 300° to 800° prevails, compatible with the characteristics of the drying device wich is fed with hot air through output duct 31. If this hot air is to be used for a ball mill, it can be from 500° to 800°, if the mill is a vertical mill of the usual type whose mechanical parts are not as well protected, the temperature should be on the order of 300° to 450° maximum.

The temperature in zone A is regulated by the quantity of air coming from duct 14 which is greater than the minimum quantity necessary for combustion (stoichiometric mixture) by 10 to 100 percent and more. It is also regulated by the position of burner 3 and by the relative positions of rod 22 and tuyere 20. The temperature in zone B is regulated by the temperature and the shape of the flame and by the intensity of the flow arriving through orifices 12. The temperature in zone C is a function of the temperature in zone B and of the air flow coming into chest 30.

Preferably, duct 15 opens into a semicircular chest 32 whose horizontal inner wall 33 has as many orifices 34 as there are orifices 12 and whose upper wall 35 is oblique so that the section of chest 32 constantly decreases, thereby insuring an equalization of the pressures and flow supply of air arriving in zone A through the various orifices 12.

Such a hot-air generator is essentially intended to operate with powdered solid fuel but it can also work with liquid or gaseous fuels which are then fed through rod 22. In this case the combustion air is still furnished by duct 14 and by relative displacement of rod 22 or by displacement of the unit as a whole, the shape and the length of the flame can be adapted to obtain the desired temperature in zones A, B and C.

This means of working is used either for the ignition or as a safety measure to avoid a flame failure, or when no solid fuel is available. The safety consists in placing photoelectric cells in enclosure 1 which immediately actuate the feed through rod 22 in case of flame failure.

An air generator as described above was fed with air preheated by passage through a heat recovery device. In a first test the air arriving through duct 13 was at a temperature of 150° and in a second test at a temperature of 450° C.

The results obtained are given in the Table below:

| Temperature Recovered | Temperature Flame | Air Combustion | Facade Air Dilution | Air Dilution Final | Total |
|---|---|---|---|---|---|
| 150° | 1300 | 2309 | 1477 | 1757 | 5543 |
| | 1750 | 1553 | 2032 | 1757 | 5342 |
| 400° C. | 1300 | 2872 | 2673 | 4452 | 9997 |
| | 1750 | 1789 | 3758 | 4452 | 9999 |

Key: A. temperature of recuperated air, B. temperature of flame, C. combustion air, D. facade dilution air, E. final dilution air.

In this table the figures shown in the last three columns are Standard cubic meters ($Nm^3$) per 1,000 calories burned.

For these two tests the flame 4 was adjusted so as to have either as lowest temperature, 1,300° or as highest temperature 1,750°.

It is clear that for a total supply substantially equivalent /sic/ 5,500 $Nm^3$ in one case and 10,000 $Nm^3$ in the other, there is a range of 450° to regulate the flame, which makes it possible to adapt it to practically any type of combustible.

According to a variation of embodiment represented in FIG. 2, an air guide 20*a* (dotted lines) with a diameter equal to that of the ring of vanes 24, can be disposed around rod 22. The air flux circulating in this second tuyere can be either pure air of dilution or air loaded with solid particles. The value of this arrangement is that it is possible to vary the rate of this flow which is intended to create the eddies 26 relative to the rate of the flow intended to create the eddies 28, making it possible to modulate as desired the agitation by these two eddy flows.

In the example described above, the device is a hot-air generator intended for the predrying of green cement work before passage through a grinder, but the invention is not limited to this particular use. The hot-air generator can be used in any application where a source of hot air is necessary, for example, for heating a group of buildings, public premises, deposts or even agricultural greenhouses.

We claim:

1. A hot-air generator comprising a cylindrical enclosure with vertical axis, whose walls are covered on the inside with refractory bricks, tranversed by a flux of air to be heated, at the top of which a burner is placed, which can operate with a liquid, gaseous or powdered solid fuel, characterized by the fact that the flux of air to be heated arrives at the said enclosure (1) through three distinct ducts (14, 15, 16); the first (14) feeding the burner with combustion air; the second (15) supplying a first current of dilution insufflated at the top of the enclosure (1), surrounding the flame (4) and circulating from top to bottom; the third (16) supplying a second dilution current insufflated at the base of the enclosure and circulating from bottom to top; so that the said enclosure (1) comprises three temperature zones: a first zone A surrounding the flame whose temperature is comprised between 1,300° and 2,000°; a second, intermediate zone B, in which the temperature is comprised between 800° and 900°; a third zone Z in which the temperature is comprised between 300° and 800°; said burner (3) both being situated inside a cylindrical chamber (10) coaxial to the enclosure (1), and including means for displacing it along its longitudinal axis so as to determine as desired the length by which it projects into the chamber (10).

2. The generator according to claim 1 in which the burner comprises a cylindrical tuyere (20) inside which a hollow rod (22) is disposed coaxially; the said tuyere (20) comprising at its end a convergent-divergent (21) and the rod (22) comprising at its end a divergent (23) and a ring of vanes (24) whose length is such that it leaves an annular open space (25) between the top (21*c*) of the convergent-divergent and the end of the vanes (24); the said hollow rod being axially displaceable relative to the tuyere (20).

3. The generator according to claim 2, in which the hollow rod (22) feeds the burner (3) with liquid or gaseous fuel; while the tuyere (20) feeds it with combustion air.

4. The generator according to claim 2 in which the hollow rod (22) feeds the burner with liquid or gaseous fuel either for ignition or for flame-failure safety, or when there is no solid fuel; while the tuyere (20) supplies it with a mixture of combustion air and powdered solid fuel.

5. The generator according to claim 2, in which the rod (22) is surrounded by a second tuyere (20*a*) inside tuyere (20), whose diameter is equal to that of the ring of vanes (24) so as to modulate, relative to one another, the rates of flow of the flux traversing the said vanes (24) and of that passing in the annular space (25).

6. The generator according to claim 2, in which the position, the shape and the temperature of the flame are regulated by the flow of combustion air in excess by 10 to 100 percent by the relative position /sic/ divergent (23) of the hollow rod (22) relative to the convergent-divergent (21) of tuyere (20) and by the position of the assembly of tuyere (20) and rod (22), that is to say of the burner (3) in chamber (10).

7. The generator according to claim 1, in which the upper part of the enclosure comprises a plurality of orifices (12) distributed in a circle around the burner and connected to duct (15) feeding the first circuit of dilution in such a way as to create around the flame a cylindrical flux of air that protects the inner wall of the enclosure (1) by containing the flame (4).

8. The generator according to claim 1 in which the enclosure is equipped at the base with a chest (30) for distribution of air, connected to the duct (16).

9. The generator according to claim 8, in which the lower end (5) of enclosure (1) is conical, the chest (31) being circular and disposed all around.

10. The generator according to claim 1, in which each air intake duct is equipped with an electrovalve so as to regulate the quantities of air.

* * * * *